US008424820B2

(12) United States Patent
Cotirla et al.

(10) Patent No.: US 8,424,820 B2
(45) Date of Patent: Apr. 23, 2013

(54) UNIVERSAL CRIB CLAMP AND METHOD OF USE

(75) Inventors: Adrian Cristian Cotirla, Forest Park, IL (US); Joseph J. Grasso, Warwick, RI (US)

(73) Assignee: Learning Curve Brands, Inc., Dyersville, IA (US)

( * ) Notice: Subject to any disclaimer, the term of this patent is extended or adjusted under 35 U.S.C. 154(b) by 0 days.

(21) Appl. No.: 13/061,476

(22) PCT Filed: Sep. 4, 2009

(86) PCT No.: PCT/US2009/056052

§ 371 (c)(1), (2), (4) Date: May 10, 2011

(87) PCT Pub. No.: WO2010/028253

PCT Pub. Date: Mar. 11, 2010

(65) Prior Publication Data

US 2011/0240816 A1 Oct. 6, 2011

Related U.S. Application Data

(60) Provisional application No. 61/094,729, filed on Sep. 5, 2008.

(51) Int. Cl.

| | |
|---|---|
| ***A47B 96/06*** | (2006.01) |
| ***E04G 3/00*** | (2006.01) |
| ***F16B 1/00*** | (2006.01) |
| ***G09F 7/18*** | (2006.01) |

(52) U.S. Cl.
USPC ..... 248/228.1; 248/228.2; 248/228.3; 248/228.5; 248/228.8; 248/214

(58) Field of Classification Search ..... 24/19, 269; 248/214, 218.4, 99
See application file for complete search history.

(56) References Cited

U.S. PATENT DOCUMENTS

| | | | | |
|---|---|---|---|---|
| 2,277,044 | A | 3/1942 | Freysinger | |
| 2,772,460 | A | 12/1956 | Berkowicz et al. | |
| 4,573,654 | A * | 3/1986 | Nottingham | 248/223.41 |
| 5,400,478 | A | 3/1995 | Levinsohn et al. | |
| 5,436,810 | A * | 7/1995 | Sutherland et al. | 362/473 |
| 5,661,876 | A * | 9/1997 | Goldenberg | 24/19 |
| 6,322,279 | B1 * | 11/2001 | Yamamoto et al. | 403/97 |

(Continued)

OTHER PUBLICATIONS

International Search Report and Written Opinion of the International Searching Authority, International Patent Application No. PCT/US2009/056052, mailed Apr. 16, 2010.

*Primary Examiner* — Amy J. Sterling
(74) *Attorney, Agent, or Firm* — Michael Best & Friedrich LLP

(57) ABSTRACT

A universal clamp for use on a crib and a method of securing the clamp to the crib. The clamp includes a first base and a second base removeably coupled to a crib. The first base includes an aperture and is configured to receive a strap and a recess. The second base includes a shaft configured to be received within the recess of the first base, a spring coupled to the shaft and being biased to retain the shaft within the recess, and a cam buckle connected to and pivotable with respect to the second base. The second base is configured to rotate with respect to the first base, and the cam buckle is configured to receive the strap to secure the clamp to the crib.

18 Claims, 7 Drawing Sheets

U.S. PATENT DOCUMENTS 6,507,980 B2 * 1/2003 Bremicker ..... 24/269
7,387,285 B2 * 6/2008 Thomason et al. ..... 248/226.11
7,762,865 B2 * 7/2010 Gelfond et al. ..... 446/227

* cited by examiner

UNIVERSAL CRIB CLAMP AND METHOD OF USE

RELATED APPLICATIONS

This application claims priority to U.S. Provisional Patent Application No. 61/094,729, filed on Sep. 5, 2008, the entire contents of which are incorporated herein by reference.

BACKGROUND OF THE INVENTION

Devices, such as mobiles and soothers, have been developed and configured to attach to a crib to provide entertainment and stimulation to an infant. Many available devices do not provide a good and easy way to be attached to cribs. Most current crib attachment methods are difficult to operate and awkward to attach to cribs. In addition, most of the available devices do not fit on any convertible crib rails. Accordingly, parents have been looking for an easier way to attach these devices to traditional cribs and convertible cribs.

SUMMARY OF THE INVENTION

A mobile and a soother are examples of devices that can attach to a crib to provide entertainment and stimulation to an infant.

The present invention provides a universal clamp that is easy to use and fits on many cribs. The universal clamp accommodates any suitable device such that multiple devices can be coupled to the clamp at the same time or individual devices can be changed to provide new entertainment and stimulation to the infant. The universal clamp also allows for different devices to be attached thereto and to provide different stimulation as the infant grows. In addition, as the infant grows, the universal clamp can be completely removed from the crib and used as a floor toy with other devices attached thereto.

In one embodiment, the present invention provides a clamp for use on a crib. The clamp includes a first base removeably coupled to a crib and a second base. The first base includes an aperture formed therein and is configured to receive a strap. The second base includes a shaft configured to be received within a recess of the first base, a spring coupled to the shaft and being biased to retain the shaft within the recess, and a cam buckle connected to and pivotable with respect to the second base. The cam buckle is configured to receive the strap, and the second base is configured to rotate with respect to the first base.

In another embodiment, the present invention provides a clamp for use on a crib. The clamp includes a first base removeably coupled to a first side of a crib wall, the first base configured to connect to at least a portion of an infant entertainment device. The first base includes an aperture formed therein and is configured to receive a strap. The clamp also includes a second base removeably coupled to a second side of a crib wall, the second base including a shaft configured to be received within a recess of the first base. The clamp also includes a spring coupled to the shaft and being biased to retain the first base adjacent to the second base, the second base configured to rotate with respect to the first base, and a cam buckle connected to the second base and configured to receive the strap.

In yet another embodiment, the invention provides a method of securing an infant entertainment device to a crib. The method includes positioning a clamp inside of a crib, the clamp including a first base removeably coupled to a crib, an aperture formed within the first base, and configured to receive a strap, a second base including a shaft configured to be received within a recess of the first base, a spring coupled to the shaft and being biased to retain the shaft within the recess, the second base configured to rotate with respect to the first base, and a cam buckle connected to and pivotable with respect to the second base, the cam buckle configured to receive the strap. The method also includes pulling the second base of the clamp away from the first base of the clamp until the second base is outside of the crib, rotating the second base of the clamp about 90 degrees with respect to the first base, releasing the second base to couple the clamp to a side wall of the crib, positioning the strap over a top rail of the crib, and threading the strap through the cam buckle to secure the clamp to the side wall of the crib.

Other aspects of the invention will become apparent by consideration of the detailed description and accompanying drawings.

DETAILED DESCRIPTION OF THE INVENTION

Figure 1:
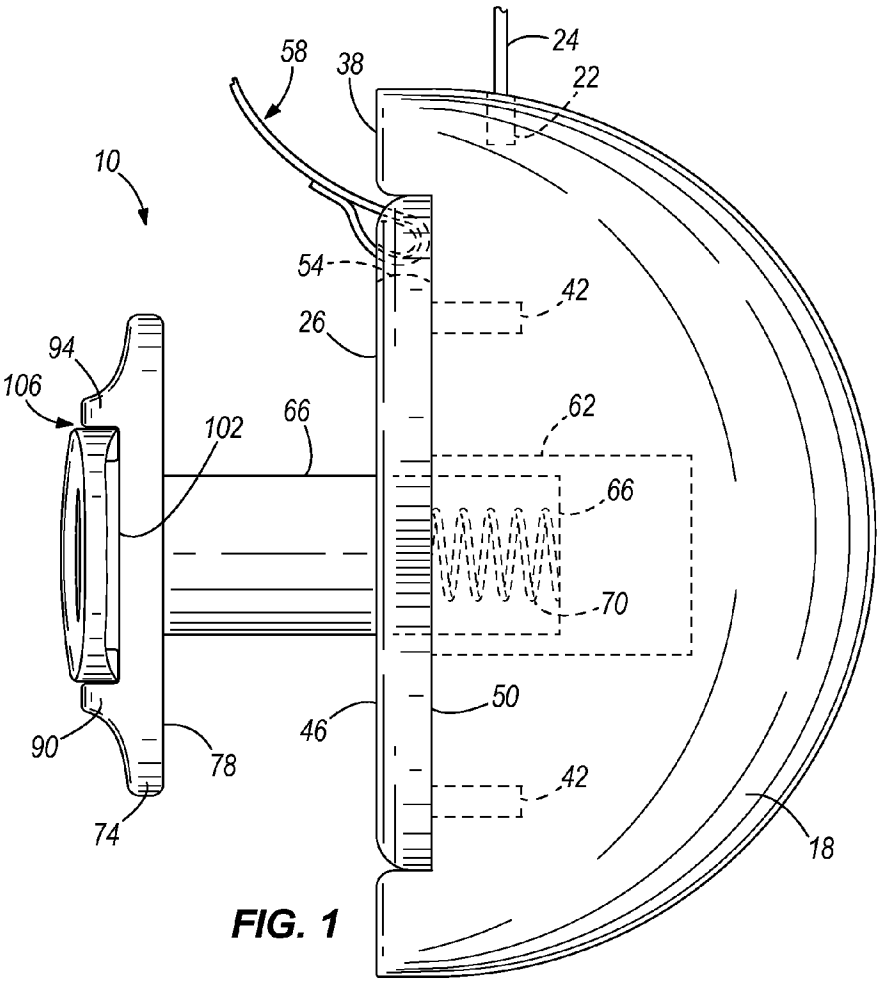
FIG. 1 is a side view of a universal clamp according to one embodiment of the present invention.
Figure 2:
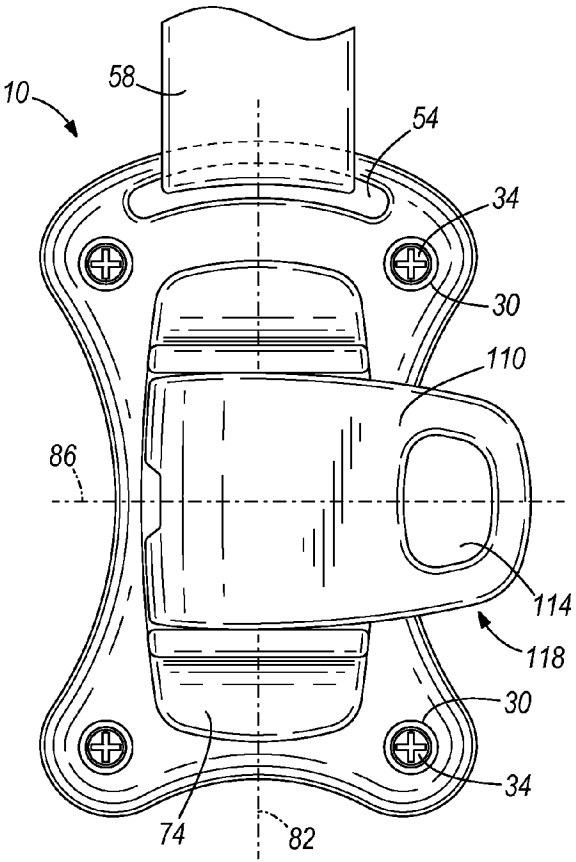
FIG. 2 is a front view of the universal clamp illustrated in FIG. 1.
Figure 4:
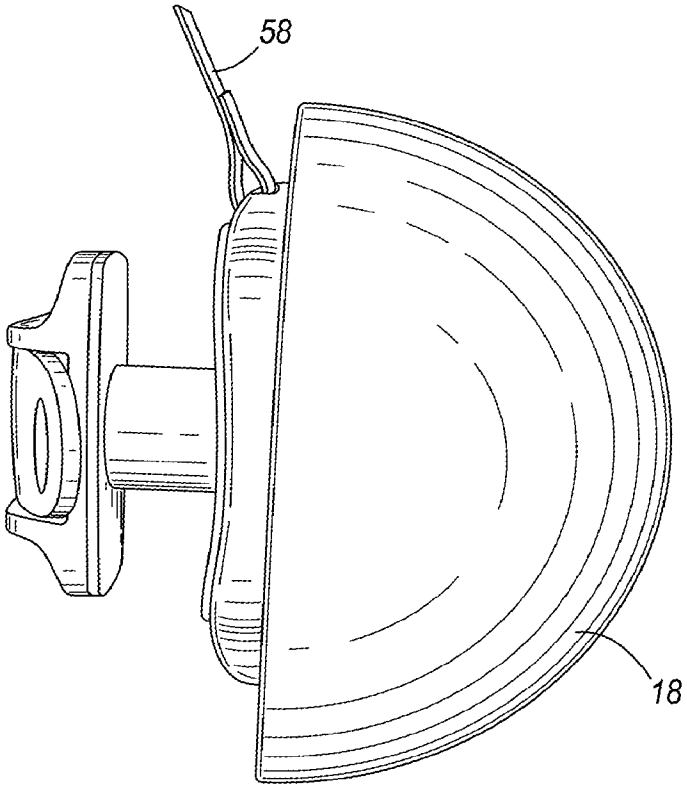
FIG. 4 is a side view of a the universal clamp illustrated in FIGS. 1-3.
Figure 3:
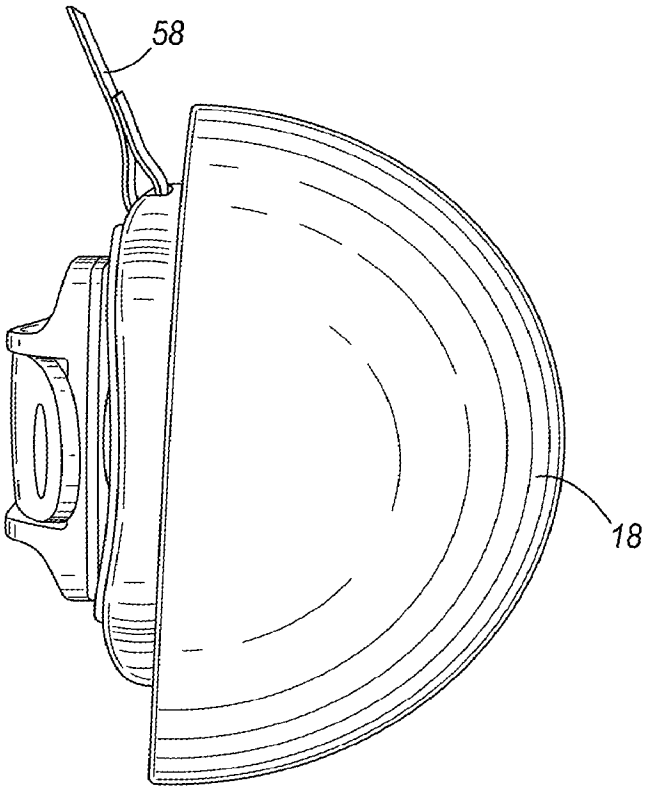
FIG. 3 is a side view of the universal clamp illustrated in FIGS. 1-2.
Figure 6:
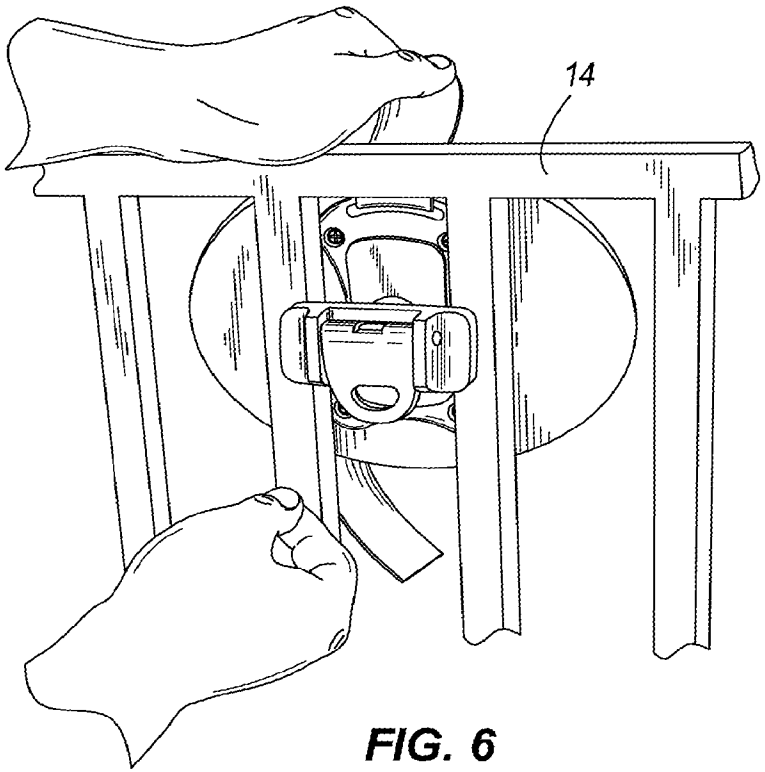
FIGS. 5-9 are perspective views of the universal clamp illustrated in FIGS. 1-2 being installed on a crib according to one embodiment of a method of the present invention.
Figure 5:
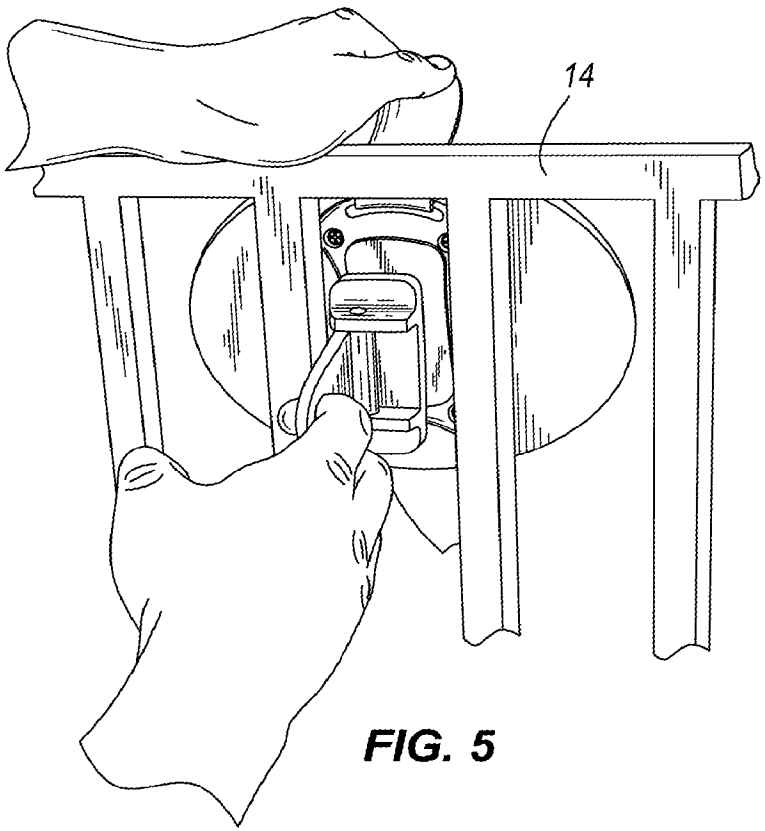
Figure 7:
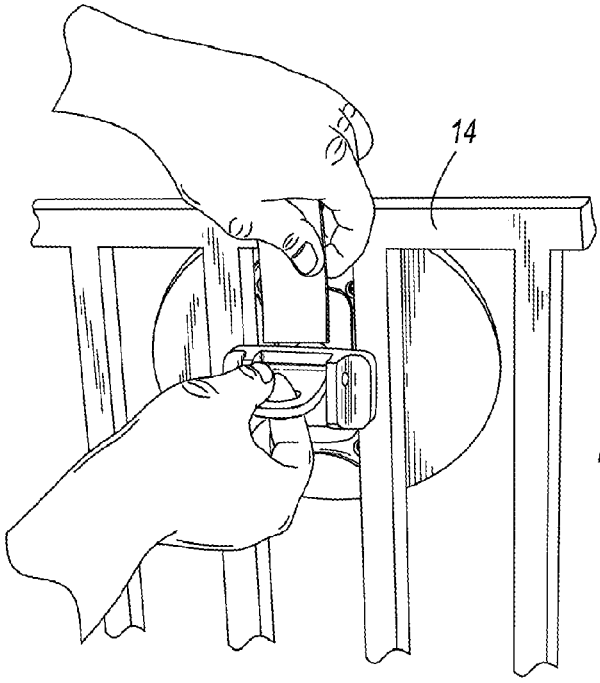
Figure 8:
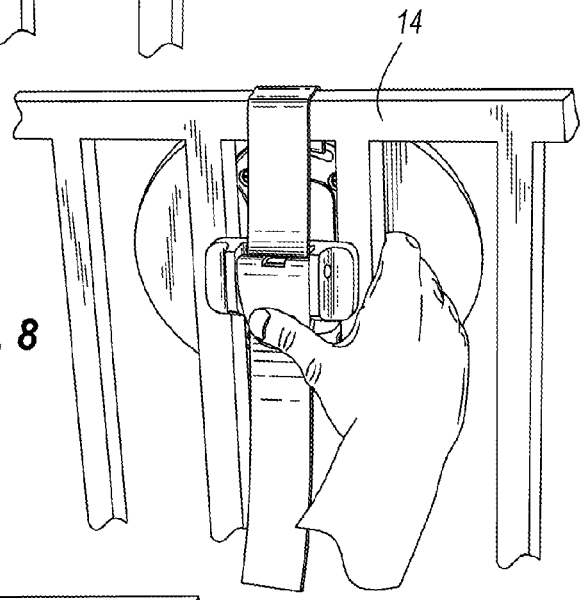
Figure 9:
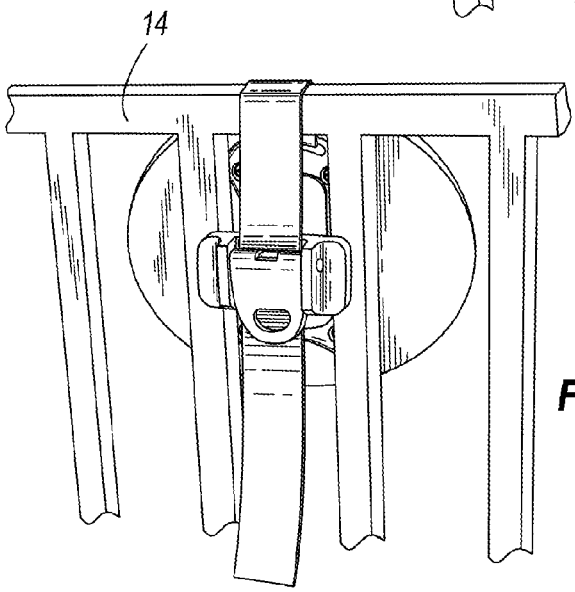

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

FIGS. 1-4 and 11-12 illustrate a universal clamp 10 configured to attach to a crib 14 such as one of the side walls or rails of the crib and to a device 18, such as an infant entertainment device. The device 18 can be a soother and/or a base that includes a recess 22 adapted to receive a post 24 of a mobile or other toy. The device 18 can include a generally hemispherical surface as illustrated, however, the universal clamp 10 can connect to a device 18 of any suitable shape and size.

The universal clamp 10 includes a first base 26 removeably connectable to the device 18. The first base 26 includes a plurality of apertures 30 adapted to receive a fastener 34, such as a screw or other suitable fasteners, to secure the base 26 to the device 18. The device 18 includes a rear surface 38 through which a plurality of bosses 42 extend and are configured to receive the fasteners 34. The first base 26 includes a front surface 46 and a rear surface 50. The front surface 46 is oriented to be coplanar with the rear surface 38 of the device 18, and the rear surface 50 is recessed within the device 18. The front surface 46 of the first base 26 can include a layer of foam or rubber material or other suitable protective or grip-like material.

The first base 26 includes an elongated aperture 54 sized to receive a strap 58. When the first base 26 is connected to the device 18, the elongated aperture 54 is oriented near an upper surface or top of the device 18. The first base 26 also includes a recess 62 formed through the front surface 46 of the first base 26 and is adapted to receive a shaft 66. The shaft 66 is secured to a spring 70 or other suitable biasing device housed within and supported in the recess 62. The spring 70 is biased to retain the shaft 66 in the first base 26 until an opposite force is applied to the spring 70 to allow the shaft 66 to extend out of the first base 26 as illustrated in FIG. 1.

The universal clamp 10 also includes a second base 74 connected to the shaft 66. The second base 74 includes a first substantially flat surface 78 oriented substantially parallel to the front surface 46 of the first base 26. The second base 74 is generally elongated and includes a first axis 82 and a second axis 86 where the first axis is generally greater than the second axis. The second base 74 is pivotable with respect to the first base 26. The first surface 78 of the second base 74 can include a layer of foam or rubber material or other suitable protective or grip-like material.

The second base 74 includes a first wall 90 and a second wall 94 spaced from the first wall 90. The first wall 90 and the second wall 94 extend from a second surface 98 of the second base 74. The first wall 90, the second wall 94, and a bottom surface 102 define a recess 106 within the second surface 98.

The recess 106 is sized to receive a tab 110. The tab 110 is coupled to and pivotable with respect to the first wall 90 and the second wall 94 such that the tab 110 can move between a first position and a second position. The tab 110 can include an aperture 114 sized to receive a human finger. The aperture 114 is positioned at a first end of the tab 118. The tab 110 also includes a block 122 on an underside surface of the tab 110. The tab 110, the first wall 90, and the second wall 94 may be referred to as a cam buckle for securing nylon webbing. The block 122 traps the strap between the block and the bottom surface 102 to prevent unintentional slippage.

Figure 10:
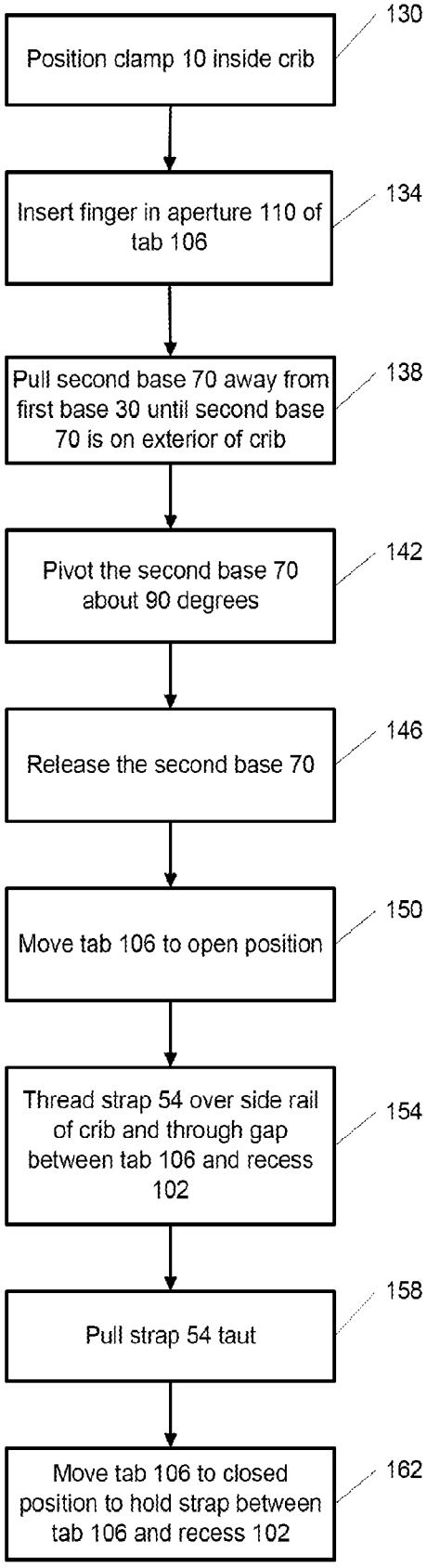
FIG. 10 is a flow chart illustrating a method of installing the universal clamp according to one embodiment of the present invention.
Figure 11:
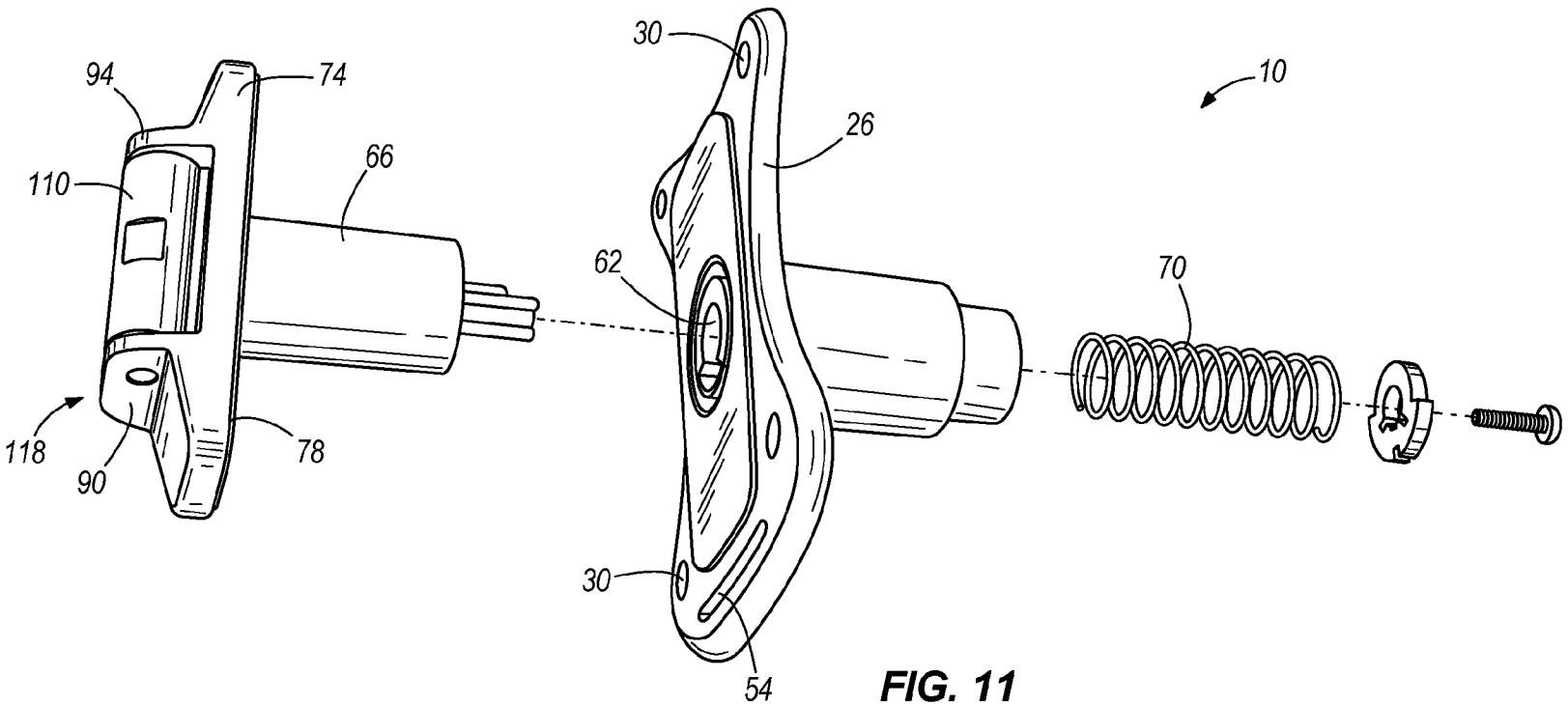
FIG. 11 illustrates an exploded view of the universal clamp illustrated in FIGS. 1-9.
Figure 12:
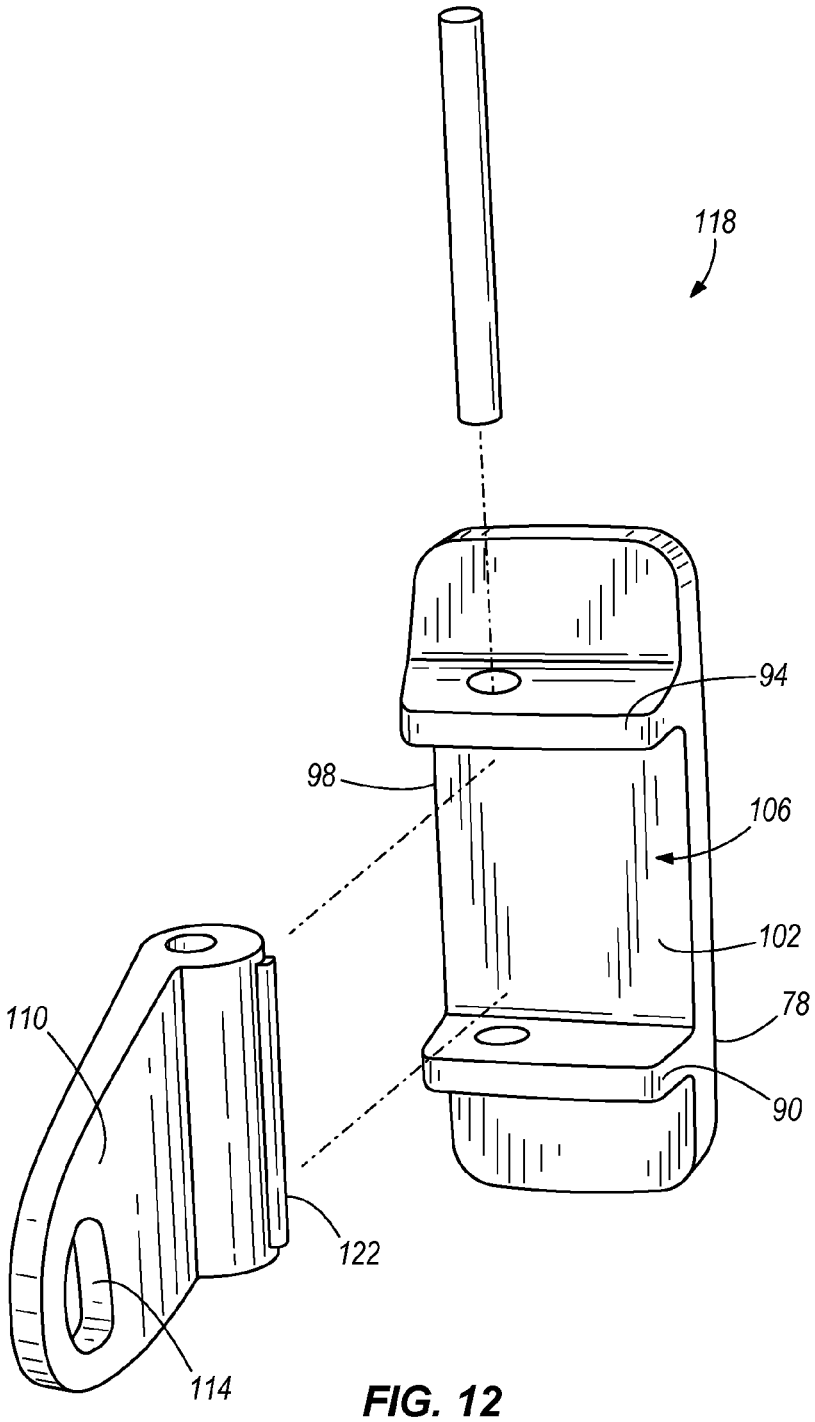
FIG. 12 illustrates an exploded view of a tab of the universal clamp illustrated in FIGS. 1-9 and 11.

FIGS. 5-9 illustrate a method of installing the universal clamp 10 onto a rail (e.g., head, foot, or side rail) or side wall of a crib 14. FIG. 10 is a flow chart of the method of installing the universal clamp 10 onto the crib. The universal clamp 10 is positioned (at 130) inside the crib 14 such that the strap 58 is at the top with respect to the top of the crib 14 and the rear surface 38 of the device 18 (and/or the first base 26) is in contact with an inside surface of the side rail of the crib 14. The second axis 86 of the second base 74 is oriented substantially parallel with respect to at least one of the vertically oriented rails of the crib 14. The user inserts (at 134) a finger in the aperture 114 of the tab 110 and pulls (at 138) the second base 74 away from the first base 26 until the second base 74 is on the outside of the side rail of the crib 14. The user then pivots (at 142) (still using the tab 119) the second base 74 (about 90 degrees) until the first axis 82 of the second base 74 is substantially perpendicular with at least one of the vertical rails of the crib 14. The user then releases (at 146) the second base 74, which becomes tightened against the vertical rails due to the spring 70 pulling on the shaft 66. The user lifts up or moves (at 150) the tab 110 to an open position and threads (at 154) the strap 58 over the side rail of the crib and through a gap between the tab 110 and the bottom surface 102 of the recess 106. The user pulls (at 158) the strap 58 taut and releases or moves (at 162) the tab 110 to a closed position such that the block 122 on the underside surface of the tab 110 tightens or secures the strap 58 between the tab 110 and the bottom surface 102 of the recess 106. The universal clamp 10 remains secured to the side rail of the crib 14 and can accommodate one or more devices 18.

Various features and advantages of the invention are set forth in the following claims.

What is claimed is:

1. A clamp for use on a crib, the crib including a rail, the clamp comprising:

a first base removeably coupled to a crib;

an aperture formed within the first base, and configured to receive a strap;

a second base including a first shaft configured to be received within a recess of the first base, the first shaft defining a first axis substantially perpendicular to the rail of the crib;

a spring coupled to the first shaft and being biased to retain the shaft within the recess, the second base configured to rotate with respect to the first base; and a cam buckle connected to and pivotable with respect to the second base, the cam buckle configured to receive the strap, wherein the second base is moveable from a first position at rest to a second position installed on the crib, the cam buckle further including a second shaft having a second axis oriented substantially perpendicular with respect to the first axis, and wherein the second axis is oriented vertically when the second base is in the first position and the second axis is oriented horizontally when the second base is in the second position.

2. The clamp of claim 1 wherein the cam buckle includes a first wall and a second wall that extend from the second base.

3. The clamp of claim 2 wherein the second base includes a second recess between the first wall and the second wall, and wherein the cam buckle includes a tab, and wherein the tab is configured to rest within the second recess.

4. The clamp of claim 3 wherein the tab is pivotable between a first position and a second position, and wherein the strap is secured within the cam buckle when the tab is in the first position.

5. The clamp of claim 1 wherein the first shaft is configured to move between a retained position and an extended position.

6. The clamp of claim 5 wherein the first base includes a first surface and a second surface, the recess being formed through the first surface, and wherein the second base includes a first surface and a second surface, and wherein the first surface of the second base remains in contact with the first surface of the first base when the first shaft is in the retained position.

7. The clamp of claim 5 wherein the first base includes a first surface and a second surface, the recess being formed through the first surface, and wherein the second base includes a first surface and a second surface, and wherein the first surface of the first base is coupled to the crib and the first surface of the second base is coupled to the crib when the first shaft is in a position between the retained position and the extended position.

8. The clamp of claim 1 wherein the second base is rotated about 90 degrees with respect to the first base when the clamp is secured to the crib.

9. The clamp of claim 1 wherein the second base includes a third axis oriented substantially perpendicular to the first axis and the second axis, and wherein a length of the strap is generally aligned with the third axis when the clamp is secured to the crib.

10. A clamp for use on a crib, the clamp comprising:

a first base removeably coupled to a first side of a crib wall, the first base configured to connect to at least a portion of an infant entertainment device;

an aperture formed within the first base, and configured to receive a strap;

a second base removeably coupled to a second side of a crib wall, the second base including a shaft configured to be received within a recess of the first base, the first shaft defining a first axis substantially perpendicular to the first and second sides of the crib wall;

a spring coupled to the shaft and being biased to retain the first base adjacent to the second base, the second base configured to rotate with respect to the first base; and a cam buckle connected to the second base and configured to receive the strap, the cam buckle including a second shaft having a second axis oriented substantially perpendicular with respect to the first axis, the second axis being rotatable about the first axis.

11. The clamp of claim 10 wherein the cam buckle includes a first wall and a second wall that extend from the second base.

12. The clamp of claim 11 wherein the second base includes a second recess between the first wall and the second wall, and wherein the cam buckle includes a tab, and wherein the tab is configured to rest within the second recess.

13. The clamp of claim 12 wherein the tab is pivotable between a first position and a second position, and wherein the strap is secured within the cam buckle when the tab is in the first position.

14. The clamp of claim 10 wherein the first shaft is configured to move between a first position and a second position.

15. The clamp of claim 14 wherein the first base includes a first surface and a second surface, the recess being formed through the first surface, and wherein the second base includes a first surface and a second surface, and wherein the first surface of the second base remains in contact with the first surface of the first base when the first shaft is in the first position.

16. The clamp of claim 14 wherein the first base includes a first surface and a second surface, the recess being formed through the first surface, and wherein the second base includes a first surface and a second surface, and wherein the first surface of the first base is coupled to the crib and the first surface of the second base is coupled to the crib when the first shaft is in a position between the first position and the second position.

17. The clamp of claim 10 wherein the second base is rotated about 90 degrees with respect to the first base when the clamp is secured to the crib.

18. The clamp of claim 10 wherein the second base includes a third axis oriented substantially perpendicular to the first axis and the second axis, and wherein a length of the strap is generally aligned with the second axis when the clamp is secured to the crib.

* * * * *